US005231904A

United States Patent [19]

Masbaum

[11] Patent Number: 5,231,904

[45] Date of Patent: Aug. 3, 1993

[54] TWO ELEMENT QUICK ADJUST WRENCH

[76] Inventor: Thomas P. Masbaum, 4938 W. Irving Park Rd., Chicago, Ill. 60641

[21] Appl. No.: 661,080

[22] Filed: Feb. 26, 1991

[51] Int. Cl.[5] ..... B25B 13/12

[52] U.S. Cl. ..... 81/126; 81/129.5; 81/150; 81/109

[58] Field of Search ..... 81/129, 129.5, 148, 81/150-154, 92, 94, 106, 109, 111, 126, 127

[56] References Cited

U.S. PATENT DOCUMENTS

| | | | |
|---|---|---|---|
| 1,004,561 | 10/1911 | Fitzgerald . | |
| 1,264,895 | 5/1918 | Carmichael | 81/126 |
| 1,389,487 | 8/1921 | Cassel . | |
| 1,397,214 | 1/1921 | Hose . | |
| 1,427,918 | 9/1922 | Stauffer . | |
| 1,464,004 | 8/1923 | Kelley | 81/129.5 |
| 1,481,250 | 1/1924 | Bohn . | |
| 1,511,526 | 10/1924 | Strickler . | |
| 1,514,017 | 11/1924 | Schroeder . | |
| 2,722,150 | 11/1955 | Green . | |
| 2,948,175 | 8/1960 | Bonkowski . | |
| 4,903,556 | 12/1988 | Spirov et al. . | |

FOREIGN PATENT DOCUMENTS

| | | | |
|---|---|---|---|
| 627537 | 8/1949 | United Kingdom | 81/150 |

*Primary Examiner*—D. S. Meislin

*Attorney, Agent, or Firm*—Wallenstein, Wagner & Hattis, Ltd.

[57] ABSTRACT

This invention is an adjustable wrench design having only two movable elements that uses contact points fixed to a movable jaw to hold the movable jaw in position. The contact points act on a guide member to bind the movable jaw from movement when the wrench is under load. Simple rotation of the movable jaw, once the load is removed, permits ready movement of the jaw to a new position.

6 Claims, 1 Drawing Sheet

Fig. 1
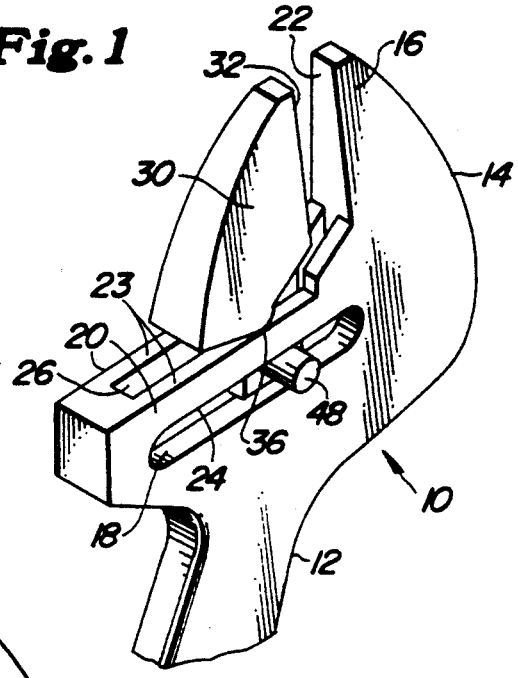
Fig. 2
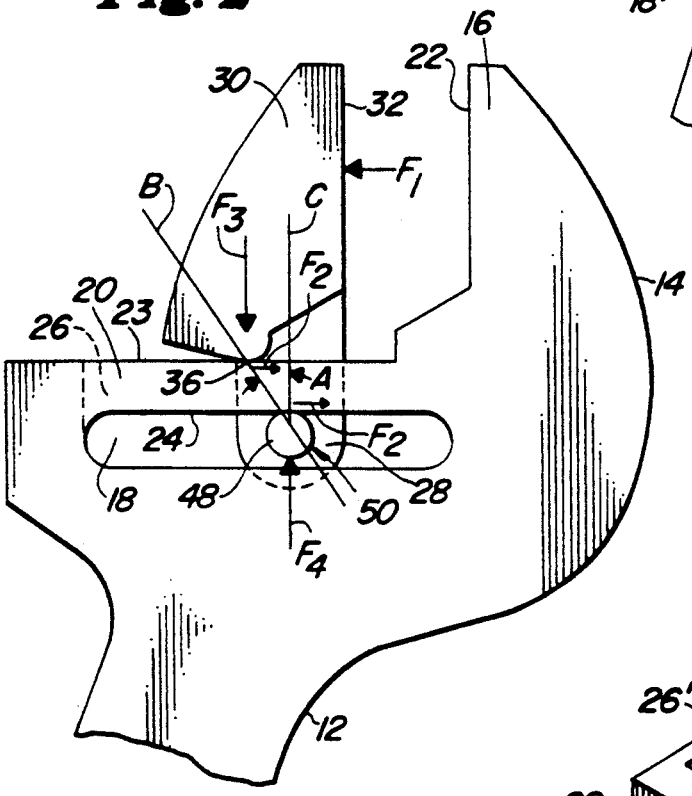
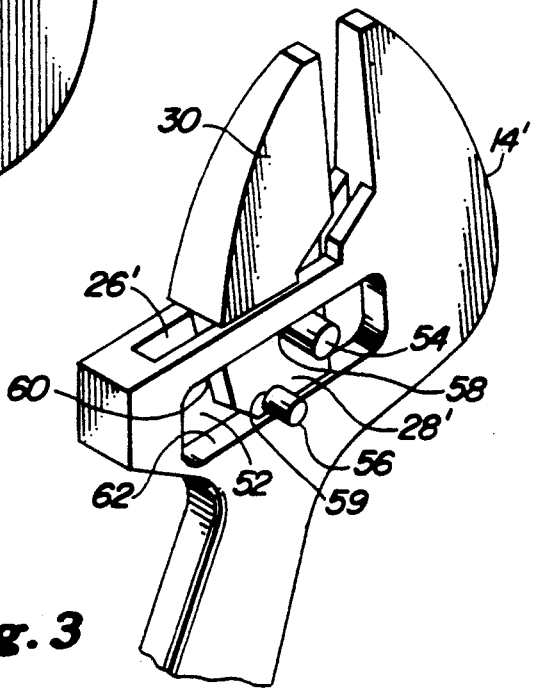
Fig. 3

TWO ELEMENT QUICK ADJUST WRENCH

BACKGROUND OF THE INVENTION

1. Field of the Invention

This invention relates generally to adjustable wrenches wherein movable elements are used to provide quick adjustment. This invention is most suitable for quick adjustable wrenches of the type wherein the jaws extend longitudinally from the handle. This type of wrench is generally referred to as an open end adjustable wrench.

2. Description of the Prior Art

In the most common type of adjustable wrench a worm gear and a journaled jaw member interact to change the relative location of the fixed and movable jaws. A pin rotatably holds the worm gear in a slot that extends through the handle of the wrench. The worm gear contacts a journaled rear portion of the movable jaw. The movable jaw slides in a groove defined by handle to a location controlled by the worm gear. U.S. Pat. No. 2,722,150 shows the general arrangement of this type of wrench. The worm gear arrangement of this typical wrench design always leaves some play between the jaws. This play results in the wrench sometimes slipping under pressure and thus detracting from the reliability of such devices.

Many adjustable wrench designs have been proposed that attempt to improve the adjustability and reliability of such wrenches. Such wrench designs include U.S. Pat. No. 1,397,214 wherein a slot in the handle of wrench retains a grooved wedge that a spring biases toward a slidably mounted movable jaw having complimentary grooves for holding the jaw in position. The movement of the wedge is relatively quick which in turn allows quick adjustment of the wrench.

A number of other quick adjustment wrench designs use a series of wedges or ramps to quickly adjust the position of the movable jaw. Basic wedge designs in adjustable wrenches are well known and depicted in U.S. Pat. Nos. 1,511,526, 1,481,250, 1,004,561, 1,514,017 and 1,427,918. Examples of wedge designs adapted for use in open end adjustable wrenches are shown in U.S. Pat. Nos. 2,948,175 and 1,389,487 wherein a wedge cooperates with an inclined surface to move the wedge forward in compression against an opposing surface of the lower jaw. Pressure exerted by the wedge locks the jaw in place until displacement of the wedge along the surface of the ramp releases the jaw. Another wedge type wrench design is shown in U.S. Pat. No. 4,903,556 where a wedge is contained in an inclined slot that extends through a handle portion of the wrench. The wedge has a flat surface on one side that acts against a surface of the slot and a tapered surface that acts against a tapered surface on the back of a movable jaw.

Although the wedge type wrench designs offer quick adjustment and generally less play than the worm gear type wrenches, the wedge type designs still require at least three distinct elements in the wrench, can be cumbersome to use, and can still slip under heavy load. In these wedge type designs the wedge acts against the walls of the slot. Pressure on the wedge causes the wedge to move or give slightly. This small amount of give still results in slippage of the wrench that deforms nuts and bolts and can cause injury to the user. In addition very high loadings on the wedge can cause the wedge to jam and make readjustment of the wrench difficult.

One object of this invention is to provide a quickly adjustable wrench of the open end type that has a reduced amount of play between the jaws relative to other open type wrench designs.

Another object of this invention is to provide a quickly adjustable open end wrench having a reduced number of parts and a simplified design.

BRIEF DESCRIPTION OF THE INVENTION

It has been discovered that the wedge action of the previous wedge type wrench designs can be achieved without the wedge. The wrench of this invention uses two contact surfaces, typically in a form to provide point contact, on the movable jaw that surround a guide bar or are trapped in a guide slot. When the contact surfaces surround a guide bar, the points are spaced apart by a minimum distance slightly greater than the width of the guide member. Contact surfaces trapped in a guide slot are separated by a maximum width slightly greater than the width of the slot. By controlling the distance between contact surfaces, the movable jaw will bind against the guide member. This binding holds the jaw in place when it is under load. Once the load is removed the jaw is readily moved and readjusted to a new position.

Particular arrangements of this invention can also overcome other problems inherent in most wedge type designs. It has been found that the problem with the other open end wrench designs that use a wedge in a slot for quick adjustment is that the wedges are always arranged in a way that will tend to enlarge the slot. As this enlarging occurs the wedge can slip slightly and a small relative movement of the jaws will occur, thereby causing the wrench to become loose.

In this invention arranging the contact surfaces or points to bind the movable jaw around a solid jaw guide prevents slippage of the lower jaw and relative movement between the jaws thereby virtually eliminating the tendency of such wrenches to loosen under load. One arrangement of this invention binds the movable jaw through a tension member that provides the two contact surfaces and passes through or straddles a solid jaw guide. The jaw guide extends in a direction generally perpendicular to the gripping surfaces of the jaws. Force on the movable jaw causes the contact surface to act in compression on the lower jaw guide. Compression on the guide increases the binding action and keeps the movable jaw in place. A very simple wrench arrangement provides the necessary binding action. Consequently, applicant has discovered a simple adjustable wrench design wherein slippage of the wedge and consequent loosing of the adjustable wrench is essentially eliminated by a simplified and easy to use design.

Accordingly, this invention is an adjustable wrench design having only two movable elements that uses contact surfaces fixed to a movable jaw to hold the movable jaw in position. The contact surfaces act on a guide member to bind the adjustable jaw from movement when the wrench is under load. Simple rotation of the movable jaw, once the load is removed, permits ready movement of the jaw to a new position.

Accordingly in one embodiment this invention is an adjustable wrench comprising a handle portion and a head portion formed at one end of the handle portion, the head portion having a fixed jaw extending outwardly from the head portion, the jaw having a first gripping face and a jaw guide located adjacent to the head, the jaw guide comprising a member providing first and second guide surfaces with one of the surfaces located on the front of the guide and the other surface located on the back of the guide. The wrench also includes a movable jaw having a second gripping face, a tongue extending from and fixed with respect to the movable jaw, first and second contact surfaces fixed with respect to the tongue, the first contact surface being positioned for contact with the first guide surface and the second contact surface being positioned for contact with the second guide surface, the tongue having at least one of the contact surfaces fixed thereto, the movable jaw having a first position relative to the handle portion permitting sliding motion between the fixed jaw and movable jaw and a second position relative to the fixed jaw wherein force on the movable jaw binds the movable jaw and prevents relative movement between the movable jaw and the fixed jaw.

In a yet further embodiment this invention is an adjustable wrench comprising a handle portion and a head portion formed at one end of the handle portion. The head portion has a fixed jaw extending outwardly from the head portion. The jaw has a first gripping face and a jaw guide located adjacent to the head. The jaw extends orthogonally away from the fixed jaw member. The jaw guide provides a first guide surface facing the fixed jaw and a second guide surface facing away from the fixed jaw.

A movable jaw has a second gripping face, and a tongue extending from the back of and fixed with respect to the movable jaw.

A first contact point is formed on the back of the movable jaw located opposite the first guide surface.

And, a pin extends transversely through a distal portion of the tongue and is located opposite the second contact point. This second contact point has an offset position with respect to the first contact point such that the second contact point is located closer to a plane containing the second gripping face than the first contact point and the first and second contact points are separated by a distance such that the second gripping face is substantially perpendicular to the first gripping face when the contact points are in contact with the jaw guide.

Additional embodiments, details, and aspects of this invention are set forth in the following detailed description of the invention.

BRIEF DESCRIPTION OF THE DRAWINGS

FIG. 1 is a three dimensional view of a the head portion of the wrench of this invention.

FIG. 2 is a plan view of the wrench head of FIG. 1.

FIG. 3 is a three dimensional view of an alternate head design for the wrench of this invention.

DETAILED DESCRIPTION OF THE INVENTION

An adjustable wrench 10 in accordance with this invention is shown in FIG. 1. The wrench includes a handle portion 12 and a head portion 14 formed at one end of the handle that provides a fixed jaw 16. A flat face 22 of fixed jaw 16 provides a gripping surface. A jaw guide 20 projects in a generally transverse direction away from the flat face 22. The head portion 14 defines a slot in the form of a window 18 in head portion 14 located to the inside of guide 20. Guide 20 has a guide surface 23 on an outer surface of head 14 and a guide surface 24 bordering window 18. Guide 20 comprises two parallel guide bars separated by a slot 26 extending across the width of the guides between the window 18 and surface 23.

Slot 26 has generally parallel sides that receive a tongue 28 of a movable jaw 30. The movable jaw has a flat face 32 that provides a gripping surface. A contact point 36 at the back of movable jaw 30 extends outwardly to sides of the tongue at the junction of tongue 28 with jaw 30 and cooperates with guide surface 22 when tongue 28 is positioned in slot 26. Contact point 36 acts against the guide surface 22 when jaw 30 is rotated away from fixed jaw 16.

When positioned in slot 26 tongue 28 extends past guide surface 24 and into a window 18. Tongue 28 defines a hole 50 that receives a pin 48. Pin 48 functions to provide a back contact point that acts against guide surface 24 when jaw 30 is rotated away from jaw 16.

To use the wrench, the surface 22 of the fixed jaw is placed against an object for gripping. The user adjusts the wrench by sliding the movable jaw 30 toward the upper jaw and into contact with the object to be gripped. Once the movable jaw contacts the object it stops and the wrench is adjusted. In order to hold the adjustment of the jaw a small spring can be arranged to maintain a light pressure on the movable jaw. This small spring will allow removal and recontact of the wrench with the same object without repeated adjustment.

When the wrench grips an object, applying force to wrench handle 12 tends to force the jaws apart. The resulting downward pressure causes the contact points to pinch the guide 20 and bind the movable jaw so that it cannot move away from the upper jaw. As the user pushes against the movable jaw it creates a force $F_1$ that act downwardly when the wrench is oriented as shown in FIG. 2. Frictional forces $F_2$ ac the guide resist force $F_1$. The eccentricity of force $F_1$ from the guide 20 creates a moment about the guide results in a force couple $F_3$ and $F_4$ that act against the lower portion of the guide as shown in FIG. 2. The action of forces $F_3$ and $F_4$ exert a binding pressure on the guide 20.

Since in the design of FIG. 2 all of the binding forces act compressively on the guide there is little deformation of the guide from the binding forces. Thus, window 18 does not open under the load and significant rotation of the movable jaw 30 is prevented. The guide will have to resist shear forces imposed by $F_3$ and $F_4$; however, the deformation produced by resisting such loadings will be substantially less than the deformation associated with opening of the slot in the prior art arrangements.

This invention also permits the jaw guide to be a simple solid member. The jaw guide can include one or more of such solid members. No special form is needed for the jaw guide, any simple cross section can be used for the guide. Preferably the cross section of the guide members is convex, and more preferably square or rectangular in cross section. It is particularly advantageous that the guide of this invention needs no dove tail or other type of complex slot arrangement as part of the guide design. In addition the invention includes only two moving parts, the handle portion and the movable jaw.

Important elements for the successful operation of this wrench are the positioning of the contact points and the spacing between the contact points relative to the width of the guide member 20. The minimum spacing between the contact points must exceed the width of guide member 20 so that the movable jaw slides freely when it is rotated toward the fixed jaw. For the purposes of this invention distance between contact points means minimum distance between actual contact surfaces and not centerline distances between pins. In order for the contact points to bind the lower jaw from movement, the contact points are offset at an angle of greater than 0° but not greater than 30° measured parallel to the plane of gripping face 32. This angle is shown as A on FIG. 2 and defined by line B and line C. Angle A is preferably set at 15°. The relative offset of the contact points from the plane of gripping face 32 works in conjunction with the angle to increase the distance between the contact points relative to the guide bar when adjusting the movable jaw and to bind the contact points and the guide when a force pushes against face 32. The contact points are preferably arranged so that the face 32 rests parallel to face 22 when the contact points are in contact with the guide.

The binding force between the contact points is inversely proportional to the angle A. Thus, angle A must remain relatively small in order to properly restrain the movable jaw. If, angle A becomes too large, the resulting force couple will not create enough frictional force to resist the downward load of $F_1$. Although the greatest force will be created when the angle A approaches 0°, such an arrangement would create a very high force couple leading to deformation of the guide, contact points or both. This deformation can again cause the slippage which this invention seeks to eliminate. Therefore, angles of less than 30° and greater than 10° have been found to work best.

The use of rounded contact points as shown in FIGS. 1 and 2 promote easy adjustment of the wrench. Although this invention does not depend on any particular type of contact point, the rounded contact points provide a small amount of contact area. Accordingly, only a small rotation of the wrench is needed to free the lower jaw, and the offset distance may be kept relatively small. However, in the case of very large loadings or small values of angle A, additional contact point surface are may be desired to prevent contact point or guide deformation that can cause the wrench to slip. Contact point area may be increased by simply using a flat surface of desired width instead of the a rounded contact point. It is also possible to use a wedge element at the contact point surface to distribute the bearing pressure of the contact point loading.

FIG. 1 shows a pin 48 that provides the back contact point. In addition, to providing a radius the pin has the added advantage of providing a retainer for the movable jaw. To assemble the wrench tongue 28 is inserted through slot 26 and then pin 48 is pressed into hole 50. The wrench is easily assembled using pin 48 as a single locking element. Pin 48 also has a length that exceeds the thickness of the wrench so that the ends of the pin extend past the sides of the wrench. Projection of the pin ends past the sides of the wrench provides a convenient place to grip the movable jaw and slide it into gripping position. In this version of the wrench, where there is only one contact point within the slot or window 18, sliding the movable jaw is facilitated by gripping the back of the 30 jaw.

Apart from the arrangement and sizing of the contact points with respect to the guide member, other details of the wrench design are not critical. Moreover, those skilled in the art will be aware of many variations in the design of the wrench that can be employed to accomplish the same results as those obtained by the wrench depicted in FIGS. 1 and 2.

In fact, from a fabrication standpoint, it may be preferred that the tongue of the movable jaw not pass through a slot. It may be easier to form the movable jaw with a pair of tongues or webs that straddle a solid guide bar in place of the arrangement of FIG. 1, where a single jaw tongue occupies the slot between two guide bar sections. When using the double tongue or web arrangement for the movable jaw, a single pin at the back of the movable jaw can occupy the slot or window and bridge the gap between the tongues or webs to retain the movable jaw with the wrench handle. Apart from the necessary changes in form, the function of the solid guide, contact points, and slot 18 would remain essentially the same in either arrangement.

However, it is not necessary to have the contact points acting against opposite sides of a solid member and guide 20 as shown in FIG. 1. Another arrangement for the wrench has the contact points acting against opposite walls of a slot into which the tongue extends. The wrench shown in FIG. 3 operates by the same principles as that shown in FIGS. 1 and 2, except that the guide member now comprises a window 52 defined by a head portion 14'. A movable jaw 30' has a tongue 28' that extends through a slot 26' into the window slot 52. A pair of pins 54 and 56 are pressed through holes 58 and 59 in tongue 28' to provide contact points. Contact point 54 acts against a wall 60 of the window 52 and contact point 56 acts against wall 62. Where the contact points act in window 52, contact point 54 is offset above contact point 56. Apart from this different offset arrangement all of the other design criteria for the contact points is the same as that described in conjunction with FIG. 1.

The description of this invention in the context of a limited number of specific embodiments is not meant to limit this scope of the claims to the details disclosed herein.

I claim:

1. An adjustable wrench comprising:

a handle portion and a head portion formed at one end of said handle portion, said head portion having a slot therein and having a fixed jaw extending outwardly from said head portion, said fixed jaw having a first gripping face and an integral jaw guide located adjacent to said head portion, said jaw guide comprising a rigid bar having a constant width and extending orthogonally away from said fixed jaw, said jaw guide providing a substantially flat first guide surface facing said fixed jaw, said second guide surface being a wall of said slot and a second guide surface facing away from said fixed jaw;

a movable jaw having a second gripping face for receiving a force and a tongue extending from the back of said movable jaw;

a force transmitting means for transmitting said force to said jaw guide;

said force transmitting means including a first contact point formed on said tongue located adjacent said first guide surface;

a pin extending transversely through a distal portion off said tongue and located adjacent said second guide surface, said pin providing means for retaining said movable jaw with said handle portion, said force transmitting means including a second contact point formed on said pin, said second contact point having an offset position with respect to said first contact point such that said second contact point is located closer to a plane containing said second gripping face than said first contact point and a line passing through said first and said second contact points form an angle of less than 45° with a plane containing said second gripping face, said first contact and second contact points being rounded to provide a small contact area and being separated by a distance such that said second gripping face is substantially parallel to said first gripping face when said contact points are in point contact with said jaw guide.

2. The wrench of claim 1 wherein a line passing through said first and second contact points forms an angle of from 10° to 30° with the plane of said second gripping face.

3. The wrench of claim 2 wherein said jaw guide comprises two parallel bars, said tongue extends through a slot between said parallel bars and said pin retains said movable jaw in said slot.

4. An adjustable wrench comprising:

a handle portion and a head portion formed at one end of said handle portion, said head portion having a fixed jaw extending outwardly from said head portion, said fixed jaw having a first gripping face and a jaw guide located adjacent to said head portion, said jaw guide comprising a slot defined by said head portion, said slot having a constant width and extending orthogonally away from said fixed jaw, one wall of said slot providing a second guide surface facing said fixed jaw and another wall of said slot providing a first guide surface facing away from said fixed jaw;

a movable jaw having an integral second gripping face and a tongue extending from the back of said movable jaw;

a first pin forming a first contact point formed on the distal end of said tongue and located adjacent said second guide surface;

a second pin located in said slot and extending transversely through an intermediate portion of said tongue and providing a second contact point located adjacent said first guide surface, said second contact point having an offset position with respect to said first contact point such that said second contact point is located closer to a plane containing said second gripping face than said first contact point, a line passing through said first and said second contact points forming an angle of less than 45° with a plane containing said second gripping face, and said first and second contact points being rounded to provide a small contact area and being separated by a distance such that said second gripping face is substantially parallel to said first gripping face when said contact points are in point contact with said jaw guide.

5. The wrench of claim 4 wherein a line passing through said first and second contact points forms an angle of from 10° from 30° with the plane of said second gripping face.

6. The wrench of claim 5 wherein a front slot extends through said first guide surface, said tongue extends through said front slot into said slot having a constant width and said pin retains said movable jaw in said constant width slot.

* * * * *